United States Patent [19]

Thomas

[11] Patent Number: 4,522,050

[45] Date of Patent: Jun. 11, 1985

[54] THREE STAND MINI MILL METHOD AND APPARATUS

[75] Inventor: John E. Thomas, Pittsburgh, Pa.

[73] Assignee: Tippins Machinery Company, Inc., Pittsburgh, Pa.

[21] Appl. No.: 458,041

[22] Filed: Jan. 14, 1983

[51] Int. Cl.[3] ..... B21B 1/06

[52] U.S. Cl. ..... 72/229; 72/234; 72/249

[58] Field of Search ..... 72/226, 229, 234, 249

[56] References Cited

U.S. PATENT DOCUMENTS

| | | | |
|---|---|---|---|
| 898,900 | 9/1908 | Lamberton | 72/229 |
| 3,331,232 | 7/1967 | King | 72/229 |
| 3,823,593 | 7/1974 | Vydrin et al. | 72/234 |

FOREIGN PATENT DOCUMENTS

| | | | |
|---|---|---|---|
| 1162796 | 2/1964 | Fed. Rep. of Germany | 72/226 |

*Primary Examiner*—Lowell A. Larson

*Attorney, Agent, or Firm*—Webb, Burden, Robinson & Webb

[57] ABSTRACT

A mini hot strip mill comprises three close coupled mill stands including a first and second four high finishing mill and a two high roughing mill positioned therebetween. A first coiler furnace is positioned upstream and a second coiler furnace is positioned downstream of the mill. The mills may each be retained in their own mill housings or the finishing mills may be in separate housings and the roughing mill may be retained in supports connecting the finishing mill housings. The mills are closely spaced so that the finishing mills are maintained open while operating in a roughing mode so as to allow free passage of the slab being reduced and the roughing mill is maintained open while the two four high mills are operative in a finishing mode. Two motors connected through a gear box to said mill provide for independently driving the finishing mills in speed coordinated relationship and for jointly driving the roughing mill.

2 Claims, 3 Drawing Figures

THREE STAND MINI MILL METHOD AND APPARATUS

BACKGROUND OF THE INVENTION

My invention relates to rolling mills and more particularly to compact mini hot strip mills for reducing a slab into a strip product.

DESCRIPTION OF THE PRIOR ART

Standard hot strip mills historically include a roughing train comprised of one or more mills which may or may not include a hot reversing mill to reduce a slab to a transfer bar of intermediate thickness and a finishing mill comprised of a plurality of closely spaced mills for receiving the transfer bar and reducing it in tandem through the finishing train to the desired strip thickness. Such mills are characterized by high productivity, high cost, large area requirements and limited flexibility as to product mix.

In order to reduce initial costs and provide for a more flexible product mix a number of more compact hot strip mills have been proposed. These mills range from substituting hot reversing mills in the roughing and/or finishing train to the single stand hot reversing mill of substantially limited productivity and quality. A need remains for a mini mill having product flexibility while maintaining a quality product at acceptable productivity levels. Such a mill must also be reasonable as to cost and space requirements.

SUMMARY OF THE INVENTION

I provide a mini mill which provides increased productivity over a single stand reversing mill and greater flexibility over the standard hot strip mills. I am able to improve roll life and surface quality and still retain reasonable productivity levels. I am able to provide a mini mill which takes up a minimum of space and which provides a substantially reduced cost over the types of mills presently in use as well as those being proposed. I not only am able to improve surface quality but I am able to improve the metallurgical properties by maintaining a better temperature control over the slab being processed. In addition to temperature control my method and apparatus provides temperature conservation. This permits lower initial slab temperature and/or allows for the rolling of carbon steel thinner and hard-to-roll specialty steels, alloys and metals. A single operator can run the mill and a wide range of rolling strategies become a reality.

My mini hot rolling mill comprises three roll stands in closely spaced apart arrangement and aligned along a pass line. Two outer roll stands are adapted to work together as a finishing train and the middle roll stand is adapted to reduce a slab to an intermediate workpiece in a roughing mode. Coiler furnaces are positioned on either side of the mill and the rolls of the finishing stands are maintained apart to permit the free passage of the slab being reduced in the roughing mode and the middle mill rolls are maintained apart while the mill is operated in a finishing mode. The coiler furnaces coil and decoil a product when it is reduced to a thickness capable of being coiled. Two motors operating through an appropriate gear box drive the entire mill. Each motor independently drives a finishing mill in speed coordinated relationship and the two motors work jointly to drive the roughing mill.

DESCRIPTION OF THE PREFERRED EMBODIMENTS

Figure 1:
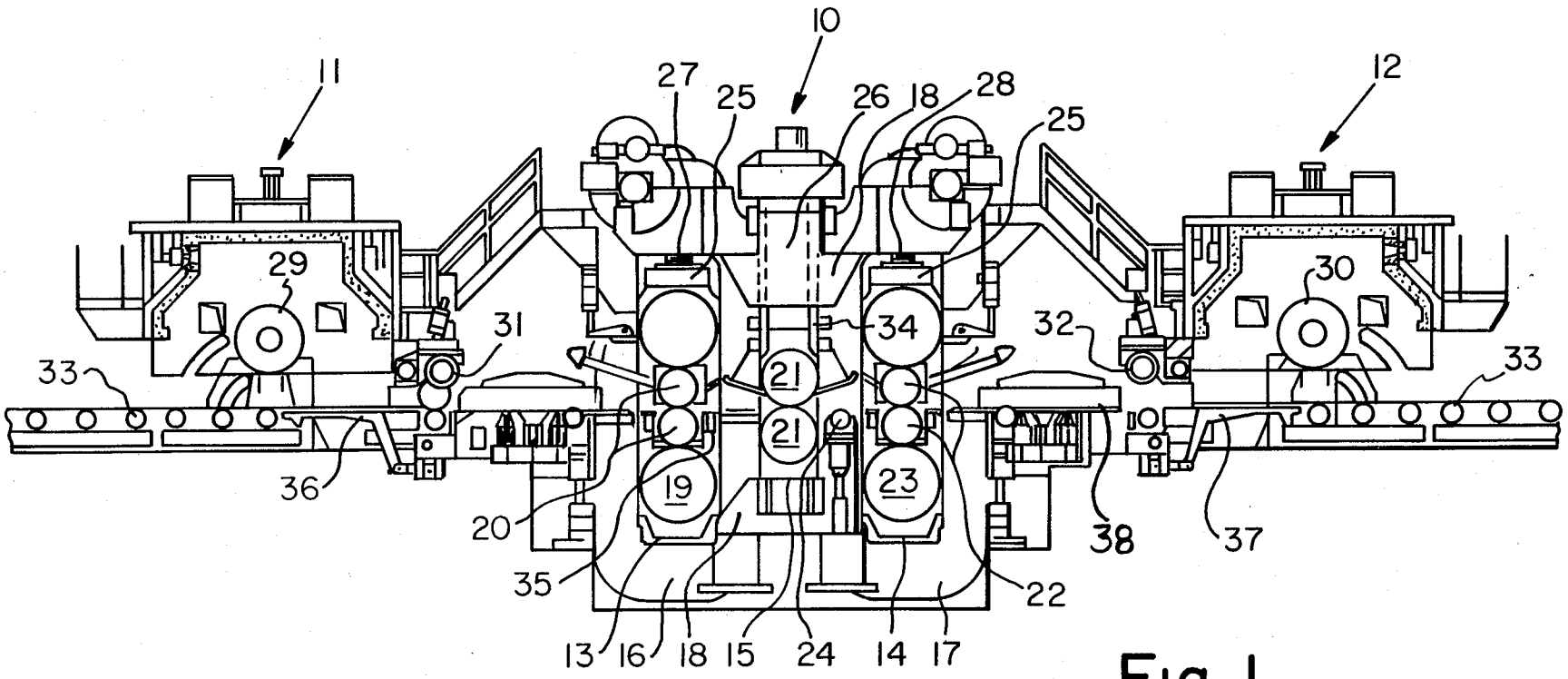
FIG. 1 is a side elevation showing my mini mill arrangement in which the rolls and coilers are illustrated as if in section.

The mini mill, generally designated 10, comprises in sequence a first coil furnace 11, a first finishing mill roll stand 13, a roughing mill roll stand 15, a second finishing mill roll stand 14 and a second coiler furnace 12, FIG. 1.

Finishing mill roll stand 13 is a four high mill retained in mill housing 16. Roll stand 13 includes a pair of finishing work rolls 20 and a pair of backup rolls 19. In a similar manner roll stand 14 is housed in mill housing 17 and includes a pair of finishing work rolls 22 and a pair of backup rolls 23.

Finishing mill 13 further includes a screw down 27 and automatic gauge control 25 commonly known in the art. Similarly roll stand 14 includes screw down 28 and automatic gauge control 25. Each finishing mill 13 and 14 is capable of having its respective pair of work rolls 20 and 22 maintained in wide open relationship by hydraulic cylinders 35 which are buried in the various roll chucks (not shown) and which become operative as respective screw downs 27 and 28 are raised.

The roughing mill 15 is retained by beams 18 which connect the mill housing 16 and 17 of the finishing mills 13 and 14. In other words a separate mill housing is not needed for the roughing mill 15. Roughing mill 15 includes screw down 26 and balance beams 34 which retain the roughing rolls 21 in spaced apart relationship when the screw down 26 is in its raised position in a manner similar to hydraulic cylinders 35.

A single mill housing could accommodate all three mill stands or each mill stand could be housed in its own mill housing. However, the arrangement disclosed hereinbefore provides a practical and reasonably inexpensive solution for housing three closely spaced roll stands. An interstand looper roll 24 is positioned between roughing stand 15 and finishing stand 14. Looper roll 24 is moveable in a vertical direction to control tension and strip speed, all of which is known in the art. Side guides 38 are located adjacent each finishing mill to control tracking of the strip. The upstream coiler furnace 11 includes a coiler 29 for receiving the strip. Adjacent coiler 11 and associated therewith is pinch roll 31 and deflector 36 for retaining the strip and deflecting it to the coiler 29 respectively. In a similar manner coiler furnace 12 downstream of the mill includes a coiler 30, a deflector 37 and a pinch roll 32 adjacent thereto. A pass line is defined along the table conveyor rolls 33 which extend into and out of the finishing mills.

Figure 2:
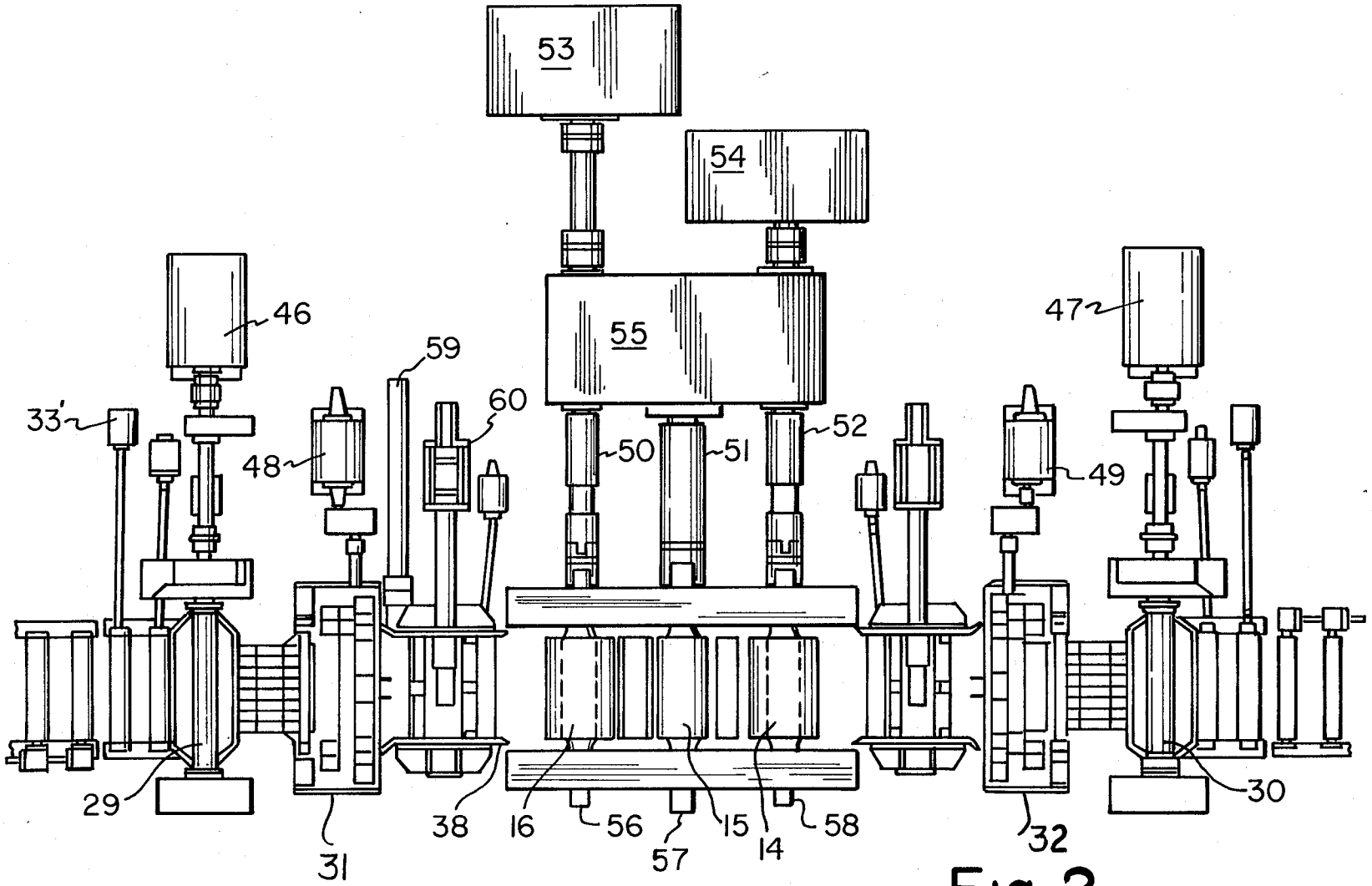
FIG. 2 is a plan view of the mini mill of FIG. 1.

The general arrangement of the various drive mechanisms for the mill 10 is best seen in FIG. 2. The coilers 29 and 30 are driven by coiler drive motors 46 and 47 respectively. A plurality of synchronized motors 33' drive the conveyor or table rolls 33. The pinch rolls 31 and 32 adjacent the coiler furnaces are driven by electric motors 48 and 49 respectively. Rack and pinion stands 60 operate the pair of side guides 38 which assist in aligning the product going into the mill. An X-ray gauge 59 is positioned adjacent the pass line and between pinch roll motor 48 and rack and pinion stand 60.

Two motors 53 and 54 connect through a gear box 55 to drive spindles 50, 51 and 52 which in turn are keyed to the respective roll necks 56, 57 and 58 of mills 16, 15 and 14.

Figure 3:
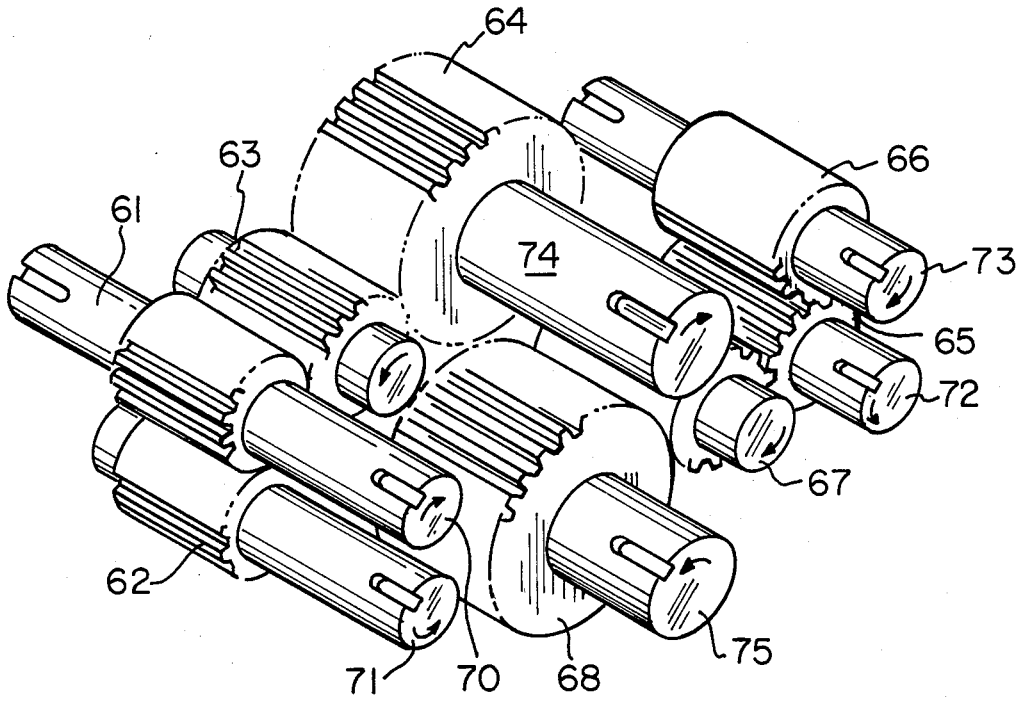
FIG. 3 is a perspective view of the gear train used to drive the mill.

The motors 53 and 54 are arranged to drive the finishing mills 16 and 14 independently but in speed coordinated relationship and to jointly drive the roughing mill 15. This is accomplished through the gearing arrangement illustrated in FIG. 3. Motor 53 drives pinion gear 61 which is meshed with driven gear 62 and idler gear 63. Pinion gear's 61 output shaft 70 is keyed to the appropriate spindle 50 to drive one of the finishing work rolls 20 of stand 16 and the output shaft 71 of driven gear 62 likewise connects to an appropriate spindle (not shown) to drive the other of the work rolls 20. In a similar manner motor 54 drives pinion gear 65 which meshes with driven gear 66 and idler gear 67. Pinion gear 65 and driven gear 66 co-act to drive roll pair 22 in the same manner that motor 53 drives work rolls 20 through gear 61 and 62, namely through keyed output shafts 72 and 73 respectively and appropriate spindle 52.

Idler gear 63 also meshes with bull gear 64 whose output shaft 74 connects through spindle 51 with upper work roll 21 of the roughing mill 15. Similarly idler gear 67 meshes with bull gear 68 which connects through output shaft 75 to the appropriate spindle (not shown) to drive the bottom work roll 21 of roughing stand 15. It will be noted that all gears which connect to spindles rotate in the same direction so that the bottom rolls of each of the mills can serve as conveying rolls when that particular mill is operating in a non-reducing mode.

It will be recognized that standard hot strip mill equipment (not shown) such as reheat furnaces, vertical edger, crop shear, water sprays, downcoilers and the like also may form a part of the overall hot strip mill line. Since the mini mill itself may be on the order of only 14 feet between the two finishing mill vertical center lines and the distance between the two coiler furnace vertical center lines may be on the order of only 64 feet, a compact yet versatile and efficient mill is provided.

The following is illustrative of one way in which my mill may be operated.

A slab generally on the order of 7 inches or thicker exits a reheat furnace or is otherwise directed from a continuous caster or the like and is conveyed along table rolls 33 toward mill 10. The coiler furnaces 11 and 12 are positioned above the pass line and out of alignment with the slab being introduced. Screw downs 27 and 28 of mills 13 and 14 are in their raised position and the hydraulic cylinders 35 maintain the work roll pairs 20 and 22 respectively in spaced apart relationship to allow the slab to freely pass therethrough. Work rolls 21 are in a work engaging position to receive the slab. The slab is passed back and forth through the work rolls 21 with the roughing mill 15 being adjusted after each pass to provide for further reduction of the workpiece. The slab which is increased in length after each reduction through the roughing mill 15 continues to freely pass through the separated work rolls 20 and 22 of the finishing stands 13 and 14. When the slab reaches a thickness which is capable of being coiled, one of the deflectors 36 or 37 is raised so as to deflect the strip onto coiler 29 or 30 respectively. Thereafter reduction takes place by passing the product back and forth between the coiling furnaces while appropriate reduction is taken in the mill.

When the slab has been reduced to a thickness of about 1 inch it is retained in one of the coiling furnaces such as coiler furnace 29 while roughing work rolls 21 are separated by raising screw down 26 and retained in spaced apart relationship by balance beams 34. At the same time screw downs 27 and 28 are lowered placing work rolls 20 and 22 into the finishing mill mode. The intermediate thickness product is then decoiled off of coiler 29 and passed through mills 20 and 22 in a finishing mode. Looper roll 24 is positioned between the rougher and the finishing stands for speed and tension control in a manner known in the art.

A typical 12 pass rolling schedule for reducing a 10 inch slab to a 0.079 inch strip product is as follows:

| 2HI MILL FLAT PASSES | | TWO STAND 4HI MILL COILING PASSES | |
|---|---|---|---|
| Pass | Direction Thickness | Pass | Direction Thickness |
| 0. | 10.0" | 7. | → 0.90" |
| 1. | → 8.5" | 8. | → 0.45" |
| 2. | ← 7.0" | 9. | ← 0.234" |
| 3. | → 5.6" | 10. | ← 0.125" |
| 4. | ← 4.3" | 11. | → 0.093" |
| 5. | → 3.0" | 12. | → 0.079" |
| 6. | ← 1.75" | | |

Generally the last flat pass (pass 6) is 2 finishing mill passes (passes 7 and 8) away from coiling.

Where surface quality is a major consideration, the roughing mill can be used as an intermediate mill as well as a rougher and only the final forward pass need be through the finishing mill. The downstream finishing mill may even be totally dedicated to a single surface quality pass. This can be achieved by maintaining the downstream finishing mill in an open mode while passing the strip through the upstream finishing mill thereby creating two or more passes on the upstream mill and a single pass on the downstream mill.

It can be seen that the above mill provides a wide range of rolling options. The direct drive of the finishing rolls provides for high speed and low torque and the joint drive of the roughing mill provides for the lower speeds and higher torques required for the greater reductions. Since the mill is arranged so all of the rolls go in the same direction whether reducing or not, the bottom work rolls of the four high finishing mills can serve as conveying rolls when the slab is in the roughing mode. It will be recognized that my invention may be otherwise embodied within the scope of the appended claims.

I claim:

1. A mini hot strip mill for reducing slabs to a strip product comprising:

A. an integrally formed three stand mill including a first and second four high finishing mill, each retained in a mill housing, and a two high roughing mill positioned between said first and second mills and retained in supports connecting the two mill housings;

B. a pair of coiling furnaces, one positioned upstream of said mill and the other positioned downstream of said mill; and C. a first and second motor connected through a gear box to said mill for driving said finishing mills independently and in speed matched relationship and for jointly driving said roughing mill whereby a slab is initially reduced to an intermediate workpiece by the roughing mill as it freely passes through the finishing mills which are maintained open in a roughing mode, said intermediate workpiece being reduced from the intermediate workpiece to the strip product on the two finishing mills while the roughing mill is maintained open and during processing said slab being coiled and decoiled in said coiler furnaces when the slab is at a thickness capable of being coiled.

2. The method of rolling a slab into a strip product comprising in sequence:

A. arranging first, second and third roll stands in closely spaced apart and aligned arrangement along a pass line;

B. positioning first and second coiling furnaces positioned upstream and downstream respectively of said roll stands;

C. providing first and second motors so as to drive said first and third roll stands independently and in speed matched relationship and so as to jointly drive said second mill stand;

D. spacing apart the rolls of the first and third roll stands to allow free passage therethrough of a slab being reduced;

E. reducing said slab to an intermediate workpiece by passing said slab back and forth through the second roll stand with the second stand being adjusted after each pass to further reduce the workpiece, said workpiece freely passing through said first and third roll stands;

F. spacing apart the rolls of the second roll stand to allow free passage therethrough of the intermediate workpiece;

G. reducing said intermediate workpiece by passing said workpiece through said first and third roll stands at least in a forward direction, said workpiece freely passing through said second roll stand; and H. coiling said intermediate workpiece when it reaches a given thickness in one of the first and second coiling furnaces positioned upstream and downstream respectively of said roll stands and thereafter decoiling said workpiece and passing it through said mill stands for coiling on the other of said coiling furnaces and thereafter passing the workpiece back and forth through the mill between coiling furnaces to a desired strip thickness.

* * * * *